US008857533B2

(12) United States Patent
Brodin

(10) Patent No.: US 8,857,533 B2
(45) Date of Patent: Oct. 14, 2014

(54) PORTABLE POWER WRENCH WITH A MANUALLY OPERATED POWER CONTROL MEANS

(75) Inventor: Hans Karl Johan Brodin, Enebyberg (SE)

(73) Assignee: Atlas Copco Industrial Technique Aktiebolag, Stockholm (SE)

( * ) Notice: Subject to any disclaimer, the term of this patent is extended or adjusted under 35 U.S.C. 154(b) by 533 days.

(21) Appl. No.: 13/141,509

(22) PCT Filed: Dec. 22, 2009

(86) PCT No.: PCT/SE2009/000536

§ 371 (c)(1),
(2), (4) Date: Jun. 22, 2011

(87) PCT Pub. No.: WO2010/074629

PCT Pub. Date: Jul. 1, 2010

(65) Prior Publication Data

US 2011/0259619 A1 Oct. 27, 2011

(30) Foreign Application Priority Data

Dec. 22, 2008 (SE) ..... 0802637

(51) Int. Cl.

| | |
|---|---|
| ***B25B 23/00*** | (2006.01) |
| ***B25B 23/147*** | (2006.01) |
| ***B25F 5/02*** | (2006.01) |
| ***B25B 21/00*** | (2006.01) |

(52) U.S. Cl.

CPC ..... *B25B 21/00* (2013.01); *B25B 23/147* (2013.01); *B25F 5/02* (2013.01)

USPC ..... 173/2; 173/170

(58) Field of Classification Search

CPC ..... F16P 3/20; B25B 23/147; B25B 23/14; B25B 23/1425; B25F 5/026; B25F 5/02; B25F 5/00; B25F 5/001

USPC ..... 173/2, 11, 18, 176, 170

See application file for complete search history.

(56) References Cited

U.S. PATENT DOCUMENTS

| | | | |
|---|---|---|---|
| 3,187,860 | A | 6/1965 | Simmons |
| 3,696,834 | A | 10/1972 | Vonhoff, Jr. |
| 4,106,750 | A | 8/1978 | Karden et al. |
| 4,125,016 | A | 11/1978 | Lehoczky et al. |

(Continued)

OTHER PUBLICATIONS

Extended European Search Report (EESR) dated Apr. 17, 2012 (in English) issued in counterpart European Application No. 09835343.6.

*Primary Examiner* — Andrew M Tecco

(74) *Attorney, Agent, or Firm* — Holtz, Holtz, Goodman & Chick PC

(57) ABSTRACT

A portable power wrench of an angle type includes an elongated housing with an angle drive head and a rear handle and supports a motor. The power wrench also includes a manually operated power control device including a main power control trigger located at the rear handle and an auxiliary power control trigger located at the angle drive head. The motor as well as the main trigger and the auxiliary power control trigger are connected to a programmable control unit in which there are stored operation parameter sets suitable for a screw joint running down phase and a final tightening phase, respectively. The auxiliary power control trigger is arranged to activate the running down parameter set only, whereas the main power control trigger is arranged to activate the final tightening parameter set.

7 Claims, 1 Drawing Sheet

(56) References Cited

U.S. PATENT DOCUMENTS

| | | | | |
|---|---|---|---|---|
| 4,669,319 | A | 6/1987 | Heyraud | |
| 5,583,386 | A * | 12/1996 | Meixner et al. | 307/326 |
| 6,612,034 | B2 * | 9/2003 | Damstra | 30/43.6 |
| 7,069,816 | B1 | 7/2006 | Saathoff et al. | |
| 7,090,030 | B2 * | 8/2006 | Miller | 173/2 |
| 7,628,219 | B2 * | 12/2009 | Frauhammer et al. | 173/18 |
| 7,836,968 | B2 * | 11/2010 | Steverding et al. | 173/1 |
| 7,982,624 | B2 * | 7/2011 | Richter et al. | 340/626 |
| 8,230,942 | B2 * | 7/2012 | Steverding et al. | 173/2 |
| 2005/0161241 | A1 * | 7/2005 | Frauhammer et al. | 173/1 |
| 2006/0208577 | A1 * | 9/2006 | Richter et al. | 307/326 |
| 2007/0114049 | A1 * | 5/2007 | Steverding et al. | 173/4 |
| 2007/0144753 | A1 * | 6/2007 | Miller | 173/217 |
| 2011/0005792 | A1 * | 1/2011 | Matthias et al. | 173/170 |

* cited by examiner

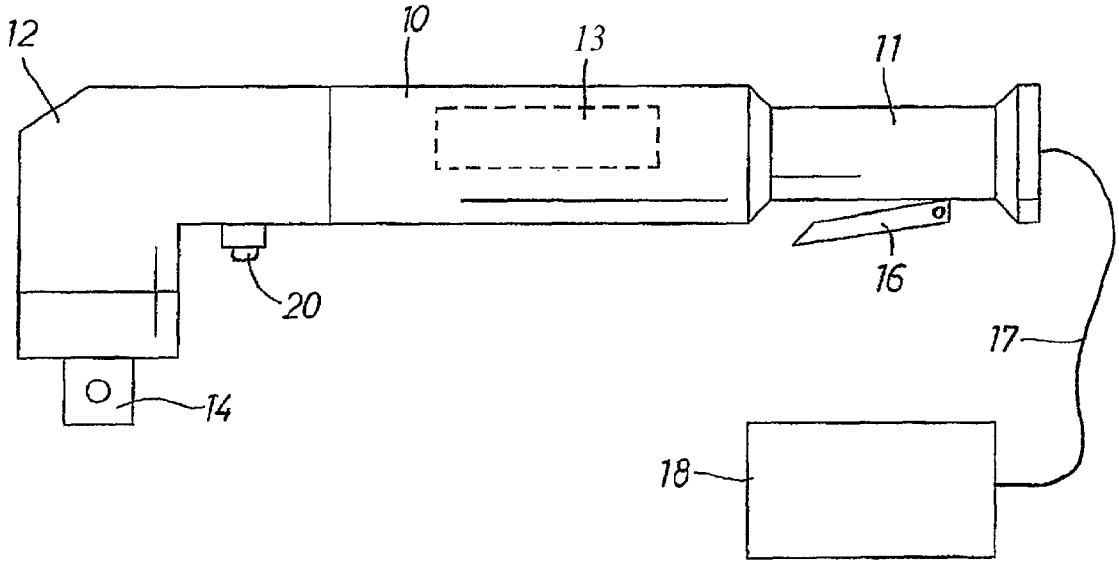
12
10
13
11
20
16
17
14
18

PORTABLE POWER WRENCH WITH A MANUALLY OPERATED POWER CONTROL MEANS

CROSS-REFERENCE TO RELATED APPLICATIONS

This application is a U.S. National Phase Application under 35 USC 371 of International Application PCT/SE/2009/000536 filed Dec. 22, 2009.

BACKGROUND OF THE INVENTION

1. Field of the Invention

The invention relates to a portable power wrench with a manually operated power control means. In particular, the invention concerns an angle type power wrench having an elongate housing with a handle and a power control means in the form of a trigger located at its rear end and an angle drive head with an output shaft at its forward end.

2. Description of the Related Art

There is a well known problem to handle an angle power wrench of the above type during an initial assembly sequence wherein one or more parts to be secured by a screw joint have to be put in their correct positions at the same time as the power wrench should be properly connected to the screw joint for applying a rotational movement thereon during an initial running down phase. When starting an assembly operation with a prior art power wrench the operator has to put the parts to be assembled in correct positions by one hand while supporting the power wrench via the handle at the rear end of the housing by the other hand. Supporting the power wrench via the rear end handle is necessary to be able to press the power control trigger and start the wrench. This means that the operator has to support the weight and balance the power wrench by one hand while holding the parts to be assembled and the screw joint by the other hand. By supporting the power wrench by the rear end handle only it is difficult for the operator to accurately balance and guide the power wrench with a nut socket attached to the output shaft into engagement with the screw joint. In practice, operators perform this "point and aim" phase by grabbing the housing at the angle drive head and at the same time holding the screw joint parts in correct positions by one hand, while he supports the rear end of the wrench and activates the power control trigger by his other hand. This two-hand power wrench guiding is a very tricky exercise and calls for a lot of experience together with a certain hand size to be able to grab and guide the housing at the angle drive head and the parts being assembled at the same time.

BRIEF SUMMARY OF THE INVENTION

It is an object of the invention to provide a portable angle type power wrench having a manually operated power control trigger arrangement intended to facilitate handling of the power wrench during application of the wrench on a screw joint to be tightened as well as during the running down phase and the final tightening phase.

It is a further object of the invention to provide a portable angle type power wrench provided with a divided power control trigger arrangement disposed at different locations on the power wrench for enabling a safe and facilitated handling of the power wrench, both during an initial application and screw joint running down phase and during a final tightening phase.

It is a still further object of the invention to provide a portable angle type power wrench having a divided power control trigger arrangement disposed at different location on the power wrench, and a power control unit programmed with two different power wrench operation parameter sets, wherein each parameter set is available via either one of the two power control triggers.

Further objects and advantages of the invention will appear from the following specification and claims.

A preferred embodiment of the invention is described below with reference to the accompanying drawing.

BRIEF DESCRIPTION OF THE DRAWING

FIG. 1 shows a schematic side view of an angle type power wrench according to an embodiment of the invention.

DETAILED DESCRIPTION OF THE INVENTION

The power wrench illustrated in FIG. 1 comprises an elongate housing 10 with a handle 11 at its rear end and an angle drive head 12 at its forward end. The housing 10 supports an electric motor 13, and a power transmission (now shown) coupling the motor 13 to an output shaft 14 journalled in the angle drive head 12. The output shaft 14 has a hexagonal end for supporting nut sockets of various sizes for engagement with screw joints to be tightened. As a common feature in this type of tools there is provided a power control trigger 16 at the handle 11 by which the operator is able to manually control the power supply to the motor 13.

The motor 13 and the power control trigger 16 are connected via a multi-conductor cable 17 to a programmable power supply and operation control means in the form of a separate control unit 18. In the control unit 18 there are stored operation parameter values adapted to different power wrench tightening strategies and different screw joint sizes. For instance, the control unit 18 may comprise different parameter sets suitable for different power wrench operation situations. These parameter sets contains parameter values related to rotational speed and torque limits, both final target torque levels and threshold values for speed change, and as explained below there is one parameter set intended for the screw joint running down phase and another parameter set intended for the final tightening phase. The first parameter set includes suitable values for running down speed and for a torque threshold by which the running down phase is completed, whereas the second parameter set includes speed control parameters for the final tightening phase and a desired target torque level.

It is to be noted that the operation control means may as well be integrated in the power wrench housing 10 or the rear handle 11 of the housing 10. This may be the case in battery powered wrenches in particular.

As described above, applying a power wrench of this type onto a screw joint to be tightened and holding and guiding parts to be assembled by the screw joint at the same time is rather tricky and requires that the operator supports the wrench by the angle drive head 12. This makes it difficult to also press the trigger 16 at the rear handle 11 to start the wrench and commence the running down phase of the screw joint. According to the invention this is substantially facilitated by the provision of an auxiliary trigger 20 located at the angle drive head 12 of the housing 10. This means that the power wrench has a main operation control trigger, which is formed by the trigger 16 on the rear handle 11 and an auxiliary operation control trigger 20, whereby the initial operation phase, i.e. the application of the output shaft carried nut socket on a screw joint and starting of the power wrench for running down the screw joint, is performed by controlling the motor operation via the auxiliary trigger 20.

A screw joint tightening operation is intended to be performed by an operator manually supporting the power wrench by grabbing the angle drive head 12 with one hand and holding and guiding the screw joint parts and/or the parts to be assembled by the screw joint with his other hand. The power wrench is started and controlled during the initial stage of operation by the operator pressing the extra trigger 20. By supporting the power wrench via the angle drive head 12 instead of the rear handle, which is the usual way to do it at prior art power wrenches, the operator gets a very good control of the wrench and may easily guide the output shaft/nut socket during the wrench application on and the running down phase of the screw joint. When the screw joint is properly seated and the running down phase is completed the operator changes his support of the wrench and moves his hand from the angle drive head 12 to the rear handle 11. In the latter position the operator is able to control the power to the motor by operating the main trigger 16, and he gets a much better ability to counteract reaction torque from the wrench during the final tightening phase up to the desired target torque level. In his angle drive head wrench supporting position the operator is able to counteract low reaction torque magnitudes only. However, the total mass inertia of the wrench housing 10, the motor and the rear handle 11 will act as an absorbing means for reaction torque peaks, thereby protecting the operator against uncomfortable jerks that may occur in the power wrench housing at for instance tightening of very stiff screw joints.

In order to prevent the operator from excessive reaction torque loads the control unit 18 is programmed to make available a particular running-down-phase parameter set when using the auxiliary control trigger 20 at the angle head 12. This means that the auxiliary trigger 20 is only effective to control power to the wrench motor at torque magnitudes below a certain level, and when a predetermined threshold torque level is reached the auxiliary trigger is made ineffective. The threshold torque level is chosen so as to correspond to a suitable screw joint condition reached at the end of the running down phase. Continued tightening of the screw joint up to the desired target torque level is performed by operating the main trigger 16 on the rear handle 11.

Suitably, the control unit 18 could be programmed to activate the two different parameter sets in a predetermined sequence such that the running down phase controlled by a first parameter set always has to be completed before the final tightening phase based on a second parameter set is activated. This increases safety for the operator as well as for the screw joint and parts to be assembled by the screw joint.

A power wrench according to the invention is advantageous in that it provides a safe and balanced pistol like grip support including a well adapted power control of the tool during the running down phase of a screw joint. This alternative grip for support and control of the power wrench provides a facilitated handling of the power wrench at engagement with a screw joint and during the initial running down phase and contributes to an improved efficiency and productivity of the power wrench.

It is to be noted that the described power wrench is just an example, and the embodiments of the invention may be freely varied within the scope of the claims. For instance, the auxiliary trigger 20 is illustrated as a button located on the underside of the angle drive head 12 but could of course be located otherwise depending on the power wrench application and what is considered most suitable for the operator. Also, the button type trigger may be exchanged by any other type of trigger device.

The invention claimed is:

1. A portable power wrench comprising:

an elongated housing formed with an angle drive head at a forward end, and a handle at a rear end;

a motor supported in the housing and drivingly connected to an output shaft journalled in the angle drive head; and a manually operated power control device including two separately activated power control triggers disposed at different locations on the housing, said power control triggers comprising a main power control trigger and an auxiliary power control trigger, wherein the auxiliary power control trigger is located on the angle drive head, and the main power control trigger is located on the handle;

wherein the auxiliary power control trigger is configured to control power to the motor at torque magnitudes below a predetermined level only, and wherein the main power control trigger is configured to control power to the motor at torque magnitudes above said predetermined level, and wherein each of the main power control trigger and the auxiliary power control trigger is adapted to separately and independently drive the portable power wrench, and wherein the portable power wrench is adapted to be driven during an initial screw joint running down phase with only one hand supporting the portable power wrench at the angle drive head to operate the auxiliary power control trigger.

2. The power wrench according to claim 1, wherein a programmable operation control unit is connected to the motor and to both of the main and auxiliary power control triggers, wherein said control unit is programmed with two different sets of operation parameters, and wherein a first one of said operation parameter sets is arranged to be activated by the auxiliary power control trigger, and a second one of said operation parameter sets is arranged to be activated by the main power control trigger.

3. The power wrench according to claim 2, wherein said first one of said operation parameter sets is adapted to control the power wrench operation during the initial screw joint running down phase, whereas said second one of said operation parameter sets is adapted to control the power wrench operation during a final screw joint tightening phase.

4. The power wrench according to claim 3, wherein said operation control unit is programmed to activate said first and second parameter sets in a certain sequence, such that said second operation parameter set cannot be activated unless said first operation parameter set has been activated and the initial running down phase of a screw joint is completed.

5. The power wrench according to claim 2, wherein said operation control unit is programmed to activate said first and second parameter sets in a certain sequence, such that said second operation parameter set cannot be activated unless said first operation parameter set has been activated and the initial running down phase of a screw joint is completed.

6. A portable power wrench comprising:

an elongated housing formed with an angle drive head at a forward end, and a handle at a rear end;

a motor supported in the housing and drivingly connected to an output shaft journalled in the angle drive head; and a manually operated power control device including two separately activated power control triggers disposed at different locations on the housing, said power control triggers comprising a main power control trigger and an auxiliary power control trigger, wherein the auxiliary power control trigger is configured to control power to the motor at torque magnitudes below a predetermined level only, and wherein the main power control trigger is configured to control power to the motor at torque magnitudes above said predetermined level, wherein a programmable operation control unit is connected to the motor and to both of the main and auxiliary power control triggers, wherein said control unit is programmed with two different sets of operation parameters, and wherein a first one of said operation parameter sets is arranged to be activated by the auxiliary power control trigger, and a second one of said operation parameter sets is arranged to be activated by the main power control trigger, and wherein said operation control unit is programmed to activate said first and second parameter sets in a certain sequence, such that said second operation parameter set cannot be activated unless said first operation parameter set has been activated and an initial running down phase of a screw joint is completed.

7. A portable power wrench comprising:

an elongated housing formed with an angle drive head at a forward end, and a handle at a rear end;

a motor supported in the housing and drivingly connected to an output shaft journalled in the angle drive head; and a manually operated power control device including two separately activated power control triggers disposed at different locations on the housing, said power control triggers comprising a main power control trigger and an auxiliary power control trigger, wherein the auxiliary power control trigger is configured to control power to the motor at torque magnitudes below a predetermined level only, and wherein the main power control trigger is configured to control power to the motor at torque magnitudes above said predetermined level, wherein a programmable operation control unit is connected to the motor and to both of the main and auxiliary power control triggers, wherein said control unit is programmed with two different sets of operation parameters, and wherein a first one of said operation parameter sets is arranged to be activated by the auxiliary power control trigger, and a second one of said operation parameter sets is arranged to be activated by the main power control trigger, wherein said first one of said operation parameter sets is adapted to control the power wrench operation during an initial screw joint running down phase, whereas said second one of said operation parameter sets is adapted to control the power wrench operation during a final screw joint tightening phase, and wherein said operation control unit is programmed to activate said first and second parameter sets in a certain sequence, such that said second operation parameter set cannot be activated unless said first operation parameter set has been activated and the initial running down phase of a screw joint is completed.

* * * * *